US006319048B1

(12) United States Patent
Aekins et al.

(10) Patent No.: US 6,319,048 B1
(45) Date of Patent: Nov. 20, 2001

(54) CRIMP LOCKED WIRE MANAGER FOR A COMMUNICATION PLUG

(75) Inventors: Robert A. Aekins, Branford, CT (US); Allen Smith, Bradford; George Kessler, Newport, both of RI (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 09/479,484

(22) Filed: Jan. 10, 2000

(51) Int. Cl.[7] ..... H01R 4/24
(52) U.S. Cl. ..... 439/418
(58) Field of Search ..... 439/418, 676, 439/841, 344

(56) References Cited

U.S. PATENT DOCUMENTS

| | | | |
|---|---|---|---|
| 4,054,350 | 10/1977 | Hardesty . | |
| 4,795,368 | 1/1989 | Muller . | |
| 5,147,215 | 9/1992 | Pritulsky . | |
| 5,556,307 | 9/1996 | Johnston . | |
| 5,571,035 * | 11/1996 | Ferill | 439/676 |
| 5,628,647 | 5/1997 | Rohrbaugh et al. . | |
| 5,647,770 | 7/1997 | Belopolsky . | |
| 5,772,465 | 6/1998 | Hwang et al. . | |
| 5,779,503 | 7/1998 | Tremblay et al. . | |
| 5,888,100 | 3/1999 | Bofill et al. . | |
| 5,899,770 | 5/1999 | Ezawa . | |
| 5,967,801 | 10/1999 | Martin et al. . | |
| 6,123,572 * | 9/2000 | Ishii et al. | 439/676 |

* cited by examiner

*Primary Examiner*—Brian Sircus
*Assistant Examiner*—Phuong K T Dinh
(74) *Attorney, Agent, or Firm*—Cummings & Lockwood

(57) ABSTRACT

A modular plug for use with unshielded twisted pair (UTP) cable of circular cross section and having a multiplicity of twisted pairs of insulated wires includes a stabilizer having an insert portion of generally rectangular cross section at one end with greater width than height. The insert portion provides a multiplicity of laterally spaced, parallel, separate channels for each of the wire pairs, and the stabilizer is fabricated of a deformable material. The plug housing is comprised of a pair of mating halves defining a cavity opening at one end thereof cooperatively dimensioned with and seating the stabilizer. The halves of the plug housing are deformable about the stabilizer to effect secure engagement thereof.

14 Claims, 6 Drawing Sheets

CRIMP LOCKED WIRE MANAGER FOR A COMMUNICATION PLUG

BACKGROUND OF THE INVENTION

The present invention relates to modular plugs for telecommunication systems and, more particularly, to such plugs with improved cross talk characteristics.

In unshielded twisted pair (UTP) data cabling systems, typically there are four pairs of wires in an insulating jacket. These systems are used in horizontal cabling as well as in patch cabling or patch cordage in which the cable is terminated in a RJ45 plug. There has been industry recognition of the need to control crosstalk in such systems, and a useful measurement parameter is designated terminated open circuit (TOC) which is the near end crosstalk (NEXT) characteristic measurement parameter that is used for connecting hardware performance verification in RJ45 plugs.

It has been recognized that the crimping procedure used in making the plug terminations may distort the TOC parameter; this crimping is used to force the insulation displacement contacts (IDC) through the insulation on the wires and also to securely engage the cable in the plug. Typically, the engagement of the cable within the plug is effected by a plug cable holding bar in the cable receiving cavity at the rear of the plug which is pressed firmly into the cable in the crimping operation. The distortion of the lay of the twisted pairs is one of the major causes of unsatisfactory and varying TOC values, and its effect can vary from plug to plug.

Accordingly, it is an object of the present invention to provide a novel modular plug for telecommunications systems using UTP cables in which the cable is securely engaged in the plug without excessive effect upon the TOC factor.

Another object is to provide such a modular plug which may be fabricated readily and relatively economically and which is easily assembled with UTP cable.

It is also an object to provide such a modular plug which facilitates the transition from the round configuration of the twisted pairs of the cable to a substantially planar or side-by-side orientation.

SUMMARY OF THE INVENTION

It has now been found that the foregoing and related objects may be readily attained in a modular plug for use with unshielded twisted pair (UTP) cable of circular cross section and having a multiplicity of twisted pairs of insulated wires comprises a stabilizer having an insert portion of generally rectangular cross section at one end with greater width than height, and having inner formations defining a multiplicity of laterally spaced, parallel channels for each of the wire pairs opening at the insert end of the stabilizer. The stabilizer is fabricated of a deformable material permitting crimping of the stabilizer. The other end of the stabilizer has an opening to receive the cable.

The plug housing is comprised of a pair of mating halves defining a cavity opening at one end thereof cooperatively dimensioned with and seating the insert end of the stabilizer. The housing provides adjacent its other end separate guide channels for each of the wires of the twisted pairs and insulation displacement contacts engageable with the wires. The housing is deformable about the stabilizer to effect secure engagement thereof.

In a preferred embodiment, the stabilizer is formed of mating halves which interengage and secure the wire pairs therein. Desirably, the mating halves of the stabilizer have interengaging elements which effect mechanical engagement thereof.

In another embodiment, there is included a heat-shrinkable sleeve adapted to encircle the cable and extend over the other end of the stabilizer to secure the cable in the stabilizer.

Desirably, the plug housing includes an intermediate portion providing a chamber in which the wires of each twisted pair are untwisted and led into the separate channels of the plug for engagement with the contacts.

DETAILED DESCRIPTION OF THE PREFERRED EMBODIMENTS

Figure 1A:
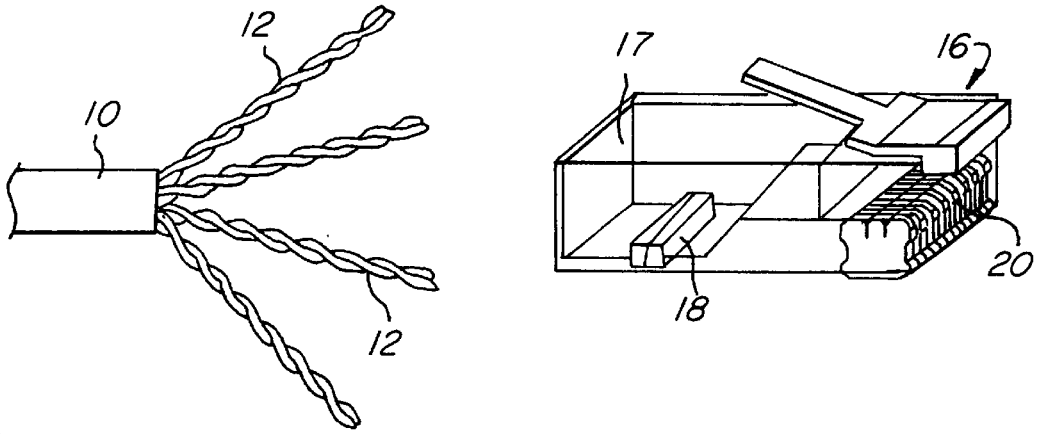
FIG. 1a (PRIOR ART)
FIG. 1*a*, FIG. 1*b* and FIG. 1*c* diagrammatically represent a typical prior art RJ45 plug/cable connection.
Figure 1B:
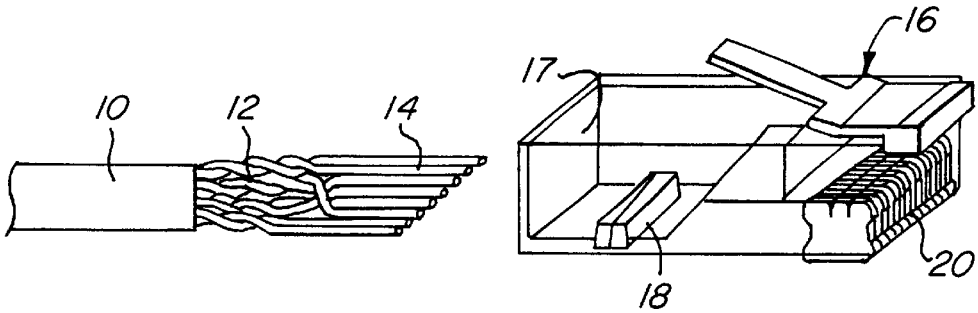
FIG. 1b (PRIOR ART)

A typical prior art cable/RJ45 plug installation is illustrated in the several figures which collectively comprise FIG. 1. Therein are diagrammatically illustrated a typical RJ45 plug generally designated by the numeral 16 and a typical UTP cable generally designated by the numeral 10 containing four twisted wire pairs generally designated by the numeral 12 with individual wires or conductors 14.

Figure 1C:
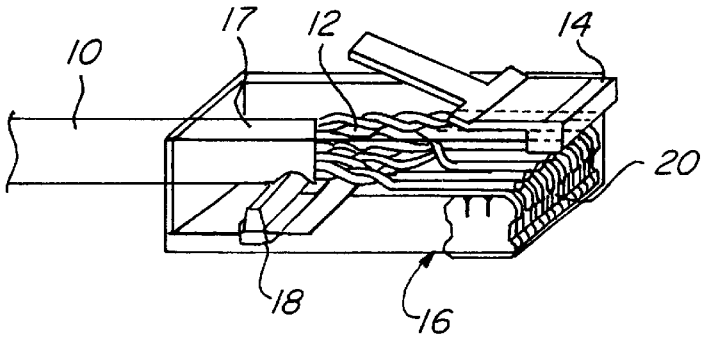
FIG. 1c (PRIOR ART)

The housing of the plug 16 has a cavity 17 into which the cable 10 is inserted and a strain relief or crimp bar 18. The housing contains eight insulation displacement contacts 20 which penetrate the insulation of the wires 14 and make contact with the conductive elements (not shown) of the connector (not shown) into which inserted. After insertion of the cable 10, crimping pressure is applied to the body of the plug 16, and the crimp bar 18 applies substantial pressure to the cable 10 and effects its deformation as seen in FIG. 1*c*. The crimping pressure applied to the housing also causes the contacts to penetrate the insulation of the wires 14.

Figure 2:
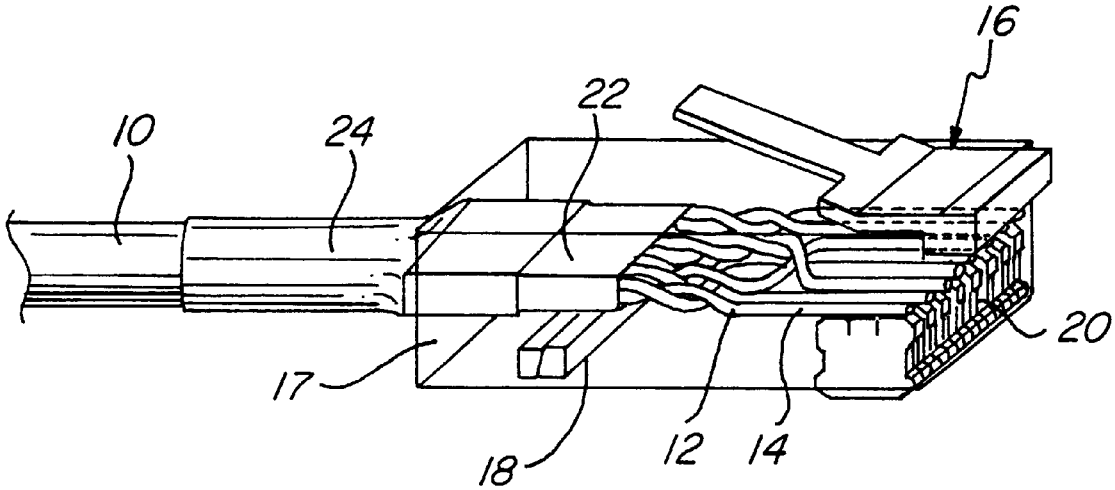
FIG. 2 is a semi-diagrammatic illustration of a cable connection utilizing a modular plug embodying the present invention.

Turning next to FIG. 2, therein illustrated a modular plug 16 which incorporates a tubular stabilizer generally designated by the numeral 22 in which the twisted wire pairs 12 are seated and by which they are aligned in a common horizontal plane. In this embodiment, heat shrinkable tubing encircles the cable 10 adjacent the plug 16 as well as the adjacent portion of the plug 16. As a result, the twisted pairs 12 and cable 10 are retained in assembly with the stabilizer 22 without distortion of their orientation.

Figure 3:
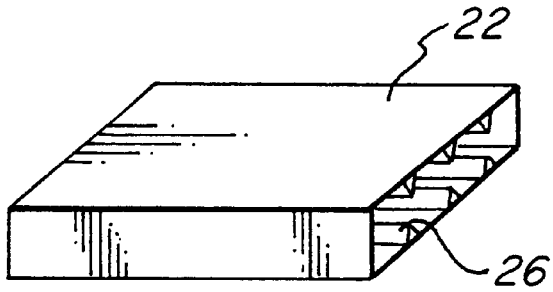
FIG. 3 is a perspective view of the stabilizer utilized in the plug of FIG. 2.
Figure 4:
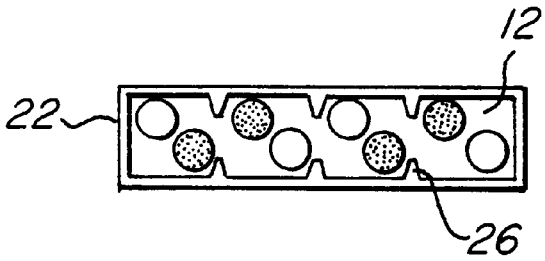
FIG. 4 is an end elevational view of the stabilizer diagrammatically showing the twisted wire pairs seated therein.
Figure 5:
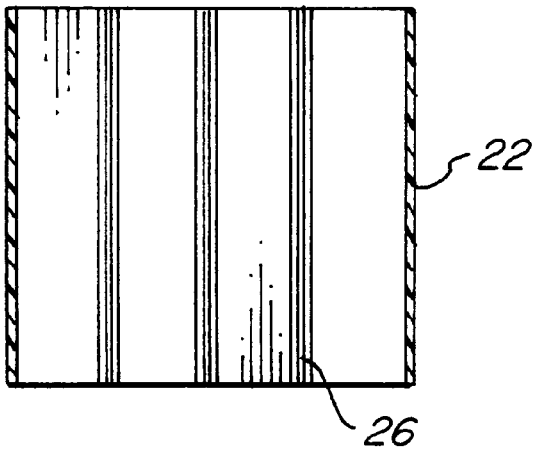
FIG. 5 is a plan view of one of the mating halves of the stabilizer.

In this instance, it can be seen that the crimp bar 18 now bears upon the stabilizer 22 which is seated in the cavity 17 rather than directly upon the wire pairs 12. As seen in FIGS. 3–5, the top and bottom walls of the tubular stabilizer 22 have opposing bosses or ribs 26 which define channels therebetween in which the twisted wire pairs 12 are seated and aligned. The resin from which the stabilizer 22 is fabricated will deform under the pressure of the crimp bar 18 to securely retain the stabilizer 22 within the plug 16 without distorting the alignment of the wire pairs 12.

Figure 6:
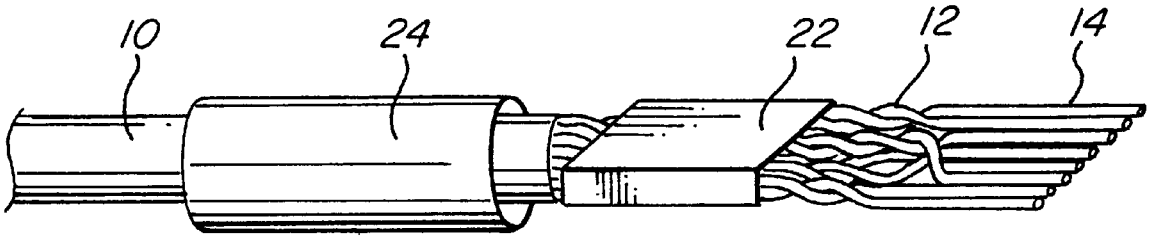
FIG. 6 is a diagrammatic view of the stabilizer with the wire pairs seated therein and with a heat-shrinkable sleeve disposed about the cable.
Figure 7:
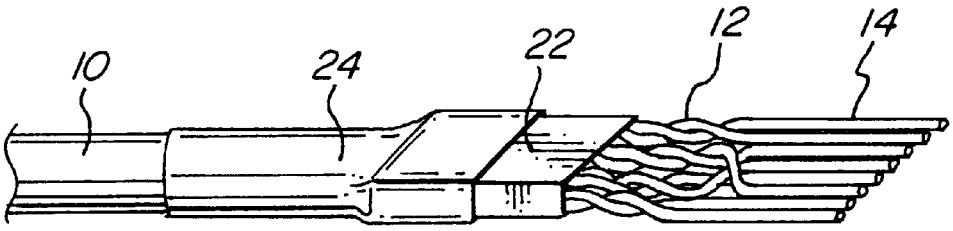
FIG. 7 is a similar view with the sleeve moved into a position overlying a portion of the stabilizer and shrunk thereabout.

FIGS. 6 and 7 illustrate the method of assembling the stabilizer 22 and cable 10. The twisted wire pairs 12 are seated in the channels of the stabilizer 22 and a length of heat shrinkable tubing 24 is placed about the cable 10 and then moved over the adjacent portion of the stabilizer 22. Heat is applied to shrink the tubing 24 to stabilize the position of the several components.

Figure 8:
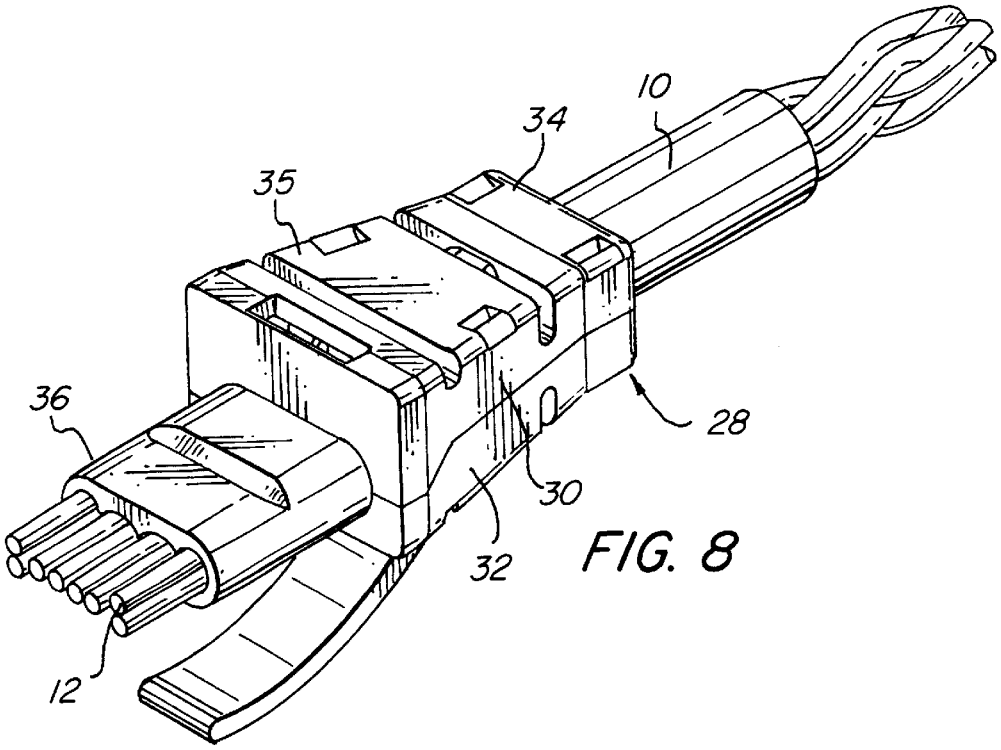
FIG. 8 is a perspective view of another embodiment of stabilizer with a cable seated therein.

FIG. 8 illustrates a preferred embodiment of stabilizer generally designated by the numeral 28 and comprised of the mating halves 30, 32 which form an entry or rear portion 34, a front or insert portion 36, and an intermediate portion 35. The cable 10 of round cross section enters the stabilizer 28 through an aperture at the rear end of the entry portion 34 and the twisted wire pairs 12 exit the insert portion 36 in a common plane.

Figure 9:
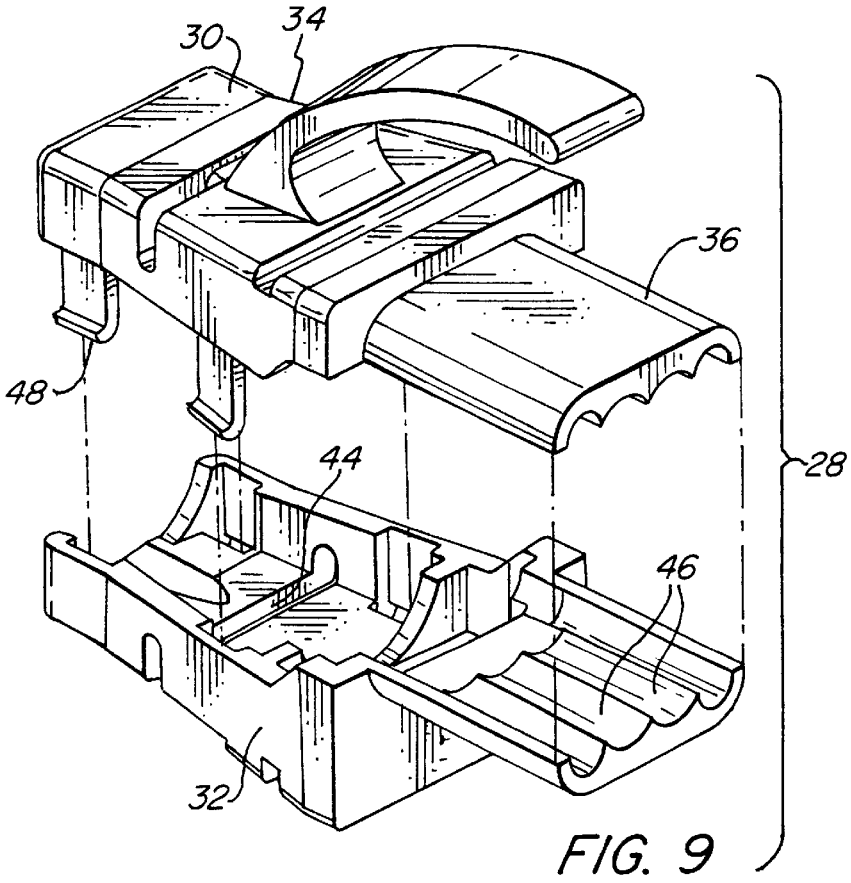
FIG. 9 is an exploded perspective view of the stabilizer of FIG. 8.
Figure 10:
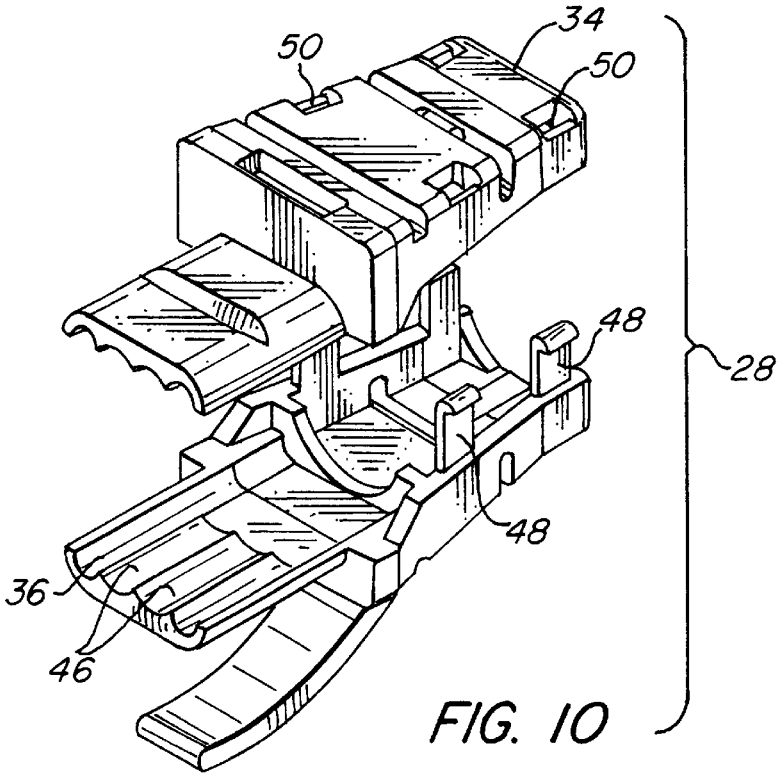
FIG. 10 is a perspective view of the mating halves of the stabilizer aligned prior to assembly.
Figure 11:
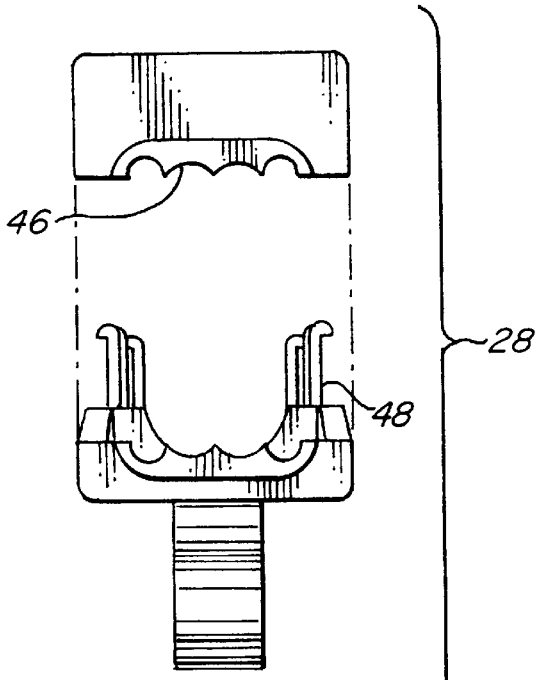
FIG. 11 is an end elevational view of the stabilizer halves prior to assembly.

As seen in FIGS. 9–11, the entry portion 34 has a crimp bar 44, and the mating halves 30, 32 thereof have cooperating pairs of lugs 48 and recesses 50. The mating halves 30, 32 of the insert portion 36 have cooperating semicircular recesses formed in their opposing surfaces to provide channels 46 in which the twisted wire pairs 12 seat. The insert portion 36 may also have cooperating pairs of lugs, and recesses so that, when the two halves 30, 32 are pressed together, the lugs snap into the recesses. The crimp bar 44 and the walls defining the entrance to the stabilizer 28 clamp the cable 10 to secure it and thus the twisted pairs 10 within the channels 46. When crimping pressure is applied to the plug 16, the stabilizer 28 is locked therein and a secure assembly is attained.

After the twisted wire pairs 12 exit the stabilizer 28 into the intermediate section of the plug 16, they may be untwisted and straightened so as to seat within individual guide channels of the plug in which they are aligned with the insulation displacement contacts as is illustrated in FIG. 2.

By stabilizing the wire pairs in the stabilizer prior to insertion into the plug and to the crimping operation which follows, the wire pairs are not distorted or separated. As a result, the terminated open circuit factor is controlled without any need for radical redesign of the standard plug.

As will be readily appreciated, the stabilizer is fabricated of a synthetic resin which is deformable such as acrylonitrile/butadiene/stryrene (ABS). The specific configuration and dimensions may vary depending upon the recess in the plug into which it will be inserted so that it can be utilized with existing plugs without requiring redesign and expensive retooling.

Thus, it can be seen from the foregoing detailed description and attached drawings that the novel plug of the present invention enables secure engagement of the wire pairs therein without distortion or excessive pressure upon the wire pairs to reduce crosstalk. It facilitates the assembly of the wires pairs of the cable into the plug and transition from the round cross section of the cable to the desired parallel orientation of the lay of the wire pairs in a common plane and then the individual wires in their channels for engagement by the insulation displacement contacts. The novel plug requires only the addition of a stabilizer which is low cost and in which the cable is easily mounted and secured.

Having thus described the invention, what is claimed is:

1. A modular plug for use with unshielded twisted pair cable (UTP) having a multiplicity of twisted pairs of insulated wires comprising:

(a) a stabilizer having a passage therethrough with an insert portion of generally rectangular cross section at one end, said insert portion being of greater width than height and providing a multiplicity of laterally spaced, parallel, separate channels for each of the wire pairs for aligning the wire pairs in a common plane, said stabilizer being fabricated of a deformable synthetic resin; and (b) a plug housing defining a cavity opening at one end thereof cooperatively dimensioned with and seating said insert portion of stabilizer, said housing providing adjacent its other end separate guide channels for each of the wires of the twisted pairs and insulation displacement contacts engageable with the wires, said housing being deformable about said stabilizer to effect secure engagement thereof.

2. The modular plug in accordance with claim 1 wherein said stabilizer is comprised of mating halves with said insert portion having inwardly projecting bosses providing said channels.

3. The modular plug in accordance with claim 2 wherein the other end of said stabilizer has an opening dimensioned to receive the cable.

4. The modular plug in accordance with claim 2 wherein said mating halves of said stabilizer have interengaging elements which effect mechanical engagement thereof.

5. The modular plug in accordance with claim 1 wherein said stabilizer is tubular with a passage therethrough and wherein there is included a heat-shrinkable sleeve adapted to encircle the cable and extend over the other end of the stabilizer.

6. The modular plug in accordance with claim 1 wherein said plug housing includes an intermediate portion providing a chamber in which the wires of each twisted pair are untwisted and led into said separate channels.

7. A modular plug for use with unshielded twisted pair cable (UTP) having a multiplicity of twisted pairs of insulated wires comprising:

(a) a stabilizer having an insert portion of generally rectangular cross section at one end with a greater width than height, said insert portion of stabilizer being comprised of mating halves with inwardly projecting bosses defining a multiplicity of laterally spaced, parallel, separate channels for each of the wire pairs for aligning the wire pairs in a common plane, and said other end of said stabilizer having an opening dimensioned to receive the cable, said mating halves of said stabilizer having interengaging elements with effect mechanical engagement thereof, said stabilizer being fabricated of a deformable material permitting crimping of said stabilizer to securely position it within the plug housing; and (b) a plug housing defining a cavity opening at one end thereof cooperatively dimensioned with and seating said insert portion of said stabilizer, said housing providing adjacent its other end separate guide channels for each of the wires of the twisted pairs and insulation displacement contacts engageable with the wires, said housing being deformable about said stabilizer to effect secure engagement thereof.

8. The modular plug in accordance with claim 7 wherein said plug housing includes an intermediate portion providing a chamber in which the wires of each twisted pair are untwisted and led into said separate channels.

9. A modular plug for use with unshielded twisted pair cable (UTP) having a multiplicity of twisted pairs of insulated wires comprising:

(a) a stabilizer having a passage therethrough with an insert portion of generally rectangular cross section, said insert portion being of greater width than height and providing a multiplicity of laterally spaced, parallel, separate channels for each of the wire pairs for aligning the wire pairs in a common plane; and (b) a plug housing defining a cavity opening at one end thereof cooperatively dimensioned with and seating said insert portion of said stabilizer, said housing providing adjacent its other end separate guide channels for each of the wires of the twisted pairs and insulation displacement contacts engageable with the wires, said housing being deformable to effect secure engagement of said stabilizer.

10. The modular plug in accordance with claim 9 wherein said plug housing is comprised of a pair of mating halves.

11. The modular plug in accordance with claim 9 wherein said stabilizer is comprised of mating halves with said insert portion having inwardly projecting bosses providing said channels.

12. The modular plug in accordance with claim 11 wherein said mating halves of said stabilizer have interengaging elements which effect mechanical engagement thereof.

13. The modular plug in accordance with claim 9 wherein said stabilizer is tubular with a passage there through and wherein there is included a heat-shrinkable sleeve adapted to encircle the cable and extend over the stabilizer.

14. The modular plug in accordance with claim 1 wherein said plug housing includes an intermediate portion providing a chamber in which the wires of each twisted pair are untwisted and led into said separate channels.

* * * * *